US007971749B2

(12) United States Patent
Drought et al.

(10) Patent No.: US 7,971,749 B2
(45) Date of Patent: Jul. 5, 2011

(54) APPARATUS FOR RELEASING TABLETS FROM BLISTER PACKS

(75) Inventors: Nicholas Andrew Murray Drought, Cambridge (GB); Stephen Blatcher, Cambridgeshire (GB); Michael Daines Gaylor, Cambridgeshire (GB); Mark Stacey Rowbotham, Hertfordshire (GB)

(73) Assignee: Gruenenthal GmbH (DE)

( * ) Notice: Subject to any disclaimer, the term of this patent is extended or adjusted under 35 U.S.C. 154(b) by 0 days.

(21) Appl. No.: 10/531,138

(22) PCT Filed: Oct. 13, 2003

(86) PCT No.: PCT/GB03/04399

§ 371 (c)(1),
(2), (4) Date: Sep. 16, 2005

(87) PCT Pub. No.: WO2004/035459

PCT Pub. Date: Apr. 29, 2004

(65) Prior Publication Data

US 2006/0151514 A1 Jul. 13, 2006

(30) Foreign Application Priority Data

Oct. 12, 2002 (GB) ..... 0223794.9

(51) Int. Cl.
*G07F 11/66* (2006.01)
*G07F 11/72* (2006.01)

(52) U.S. Cl. ..... 221/25; 221/30; 221/194; 221/195; 221/31; 221/71; 221/76; 221/88; 221/87; 414/412

(58) Field of Classification Search ..... 221/30, 221/25, 194, 195, 31, 71, 76, 88, 87; 414/412
See application file for complete search history.

(56) References Cited

U.S. PATENT DOCUMENTS

| | | | | |
|---|---|---|---|---|
| 4,858,478 | A * | 8/1989 | Kush et al. | 73/864.35 |
| 4,891,886 | A * | 1/1990 | Diamant et al. | 30/363 |
| 4,905,866 | A * | 3/1990 | Bartell et al. | 221/5 |
| 5,009,561 | A * | 4/1991 | Lombardino et al. | 414/412 |
| 5,038,968 | A * | 8/1991 | Albetski | 221/1 |
| 5,096,319 | A * | 3/1992 | Gueret | 401/126 |
| 5,302,048 | A * | 4/1994 | Paulos et al. | 404/11 |
| 5,332,096 | A * | 7/1994 | Battaglia | 206/532 |
| 5,348,158 | A * | 9/1994 | Honan et al. | 206/531 |

(Continued)

FOREIGN PATENT DOCUMENTS

DE 3317549 A1 11/1984

(Continued)

*Primary Examiner* — Gene O. Crawford
*Assistant Examiner* — Rakesh Kumar
(74) *Attorney, Agent, or Firm* — Barnes & Thornburg LLP

(57) ABSTRACT

Apparatus for releasing tablets from a blister pack (3) having a plurality of tablets (41) contained in corresponding blisters (40), the apparatus comprising abutment means (30), receiving means (10, 26) for receiving a blister pack with any selected one of a plurality of blisters of the pack in registry with the abutment means, either one of the abutment means (30) and the receiving means (10, 26) being moveable to cause a collapsing force to be exerted on a selecting blister thereby to release a tablet from the blister, wherein the apparatus includes biasing means (14, 20) for urging the receiving means into engagement with the blister pack, and that the receiving means is so arranged that said engagement releasably retains, and locates, the blister pack in position relative to the abutment means prior to the release of the tablet.

8 Claims, 7 Drawing Sheets

U.S. PATENT DOCUMENTS 5,431,283 A * 7/1995 Weinstein et al. ..... 206/531
5,472,115 A * 12/1995 Whiton ..... 221/25
5,722,563 A * 3/1998 Hunts ..... 221/25
5,791,513 A * 8/1998 Intini ..... 221/30
5,909,822 A * 6/1999 George et al. ..... 221/25
5,974,929 A * 11/1999 Kugel et al. ..... 83/582
5,988,429 A * 11/1999 Coe ..... 221/25
6,082,544 A * 7/2000 Romick ..... 206/531
6,155,454 A * 12/2000 George et al. ..... 221/25
6,206,233 B1 * 3/2001 Schulze ..... 221/25
6,460,693 B1 * 10/2002 Harrold ..... 206/1.5
6,557,740 B1 * 5/2003 Dent ..... 225/104
6,758,367 B2 * 7/2004 Hunts ..... 221/25
2005/0139605 A1 * 6/2005 Benktzon et al. ..... 221/25

FOREIGN PATENT DOCUMENTS

EP 0305895 A1 3/1989
EP 305895 A1 * 3/1989
WO WO-2004/035459 A1 4/2004

* cited by examiner

APPARATUS FOR RELEASING TABLETS FROM BLISTER PACKS

FIELD OF THE INVENTION

This invention relates to apparatus for a releasing tablets from a blister pack having a plurality of tablets contained in corresponding blisters.

BACKGROUND OF THE INVENTION

It is common for various types of medicament to be supplied in tablet form in blister packs. Such a pack typically comprises a matrix array of blisters, each of which contains a respective tablet, which are sealed by a common foil seal across one face of the pack. In order to release a tablet from its blister, a sufficient collapsing force is to be applied to the blister to cause the tablet therein to rupture the portion of foil which seals that blister.

Although an able bodied person can relatively easily release a tablet, someone of reduced manual dexterity can find it difficult to apply a sufficient collapsing force to the blister. U.S. Pat. No. 5,791,513 shows a device which, in essence, acts as a stamp for ejecting a tablet from a blister pack. While such a device will help a person of reduced manual dexterity, it can still be awkward to use since the user has to ensure that the blister pack is correctly positioned in the device with the blister containing a tablet to be ejected in registry with the appropriate portion of the stamp.

It is also known to provide devices in which a blister back is held within a housing that also has a plurality of stamps, each in registry with a respective blister, or a single stamp which can move from one blister to another. Such designs are, however, still relatively complex (and therefore expensive to produce), and can also still be awkward to use.

SUMMARY OF THE INVENTION

According to the invention, there is provided apparatus for releasing tablets from a blister pack having a plurality of tablets contained in corresponding blisters, the apparatus comprising abutment means, receiving means for receiving a blister pack with any selected one of a plurality of blisters of the pack in registry with the abutment means, either one of the abutment means and the receiving means being moveable to cause a collapsing force to be exerted on selected blister thereby to release a tablet from the blister, wherein the apparatus includes biasing means for urging the receiving means into engagement with the blister pack, and the receiving means is so arranged that said engagement releasably retains, and locates, the blister pack in position relative to the abutment means prior to the release of the tablet.

By locating the blister pack, the receiving means helps the user correctly to position a blister pack relative to the abutment means. The receiving means also avoids the need for the user to hold the blister pack in a precise position relative to the abutment means.

Preferably, the abutment means is moveable towards a blister of a pack retained in the receiving means.

Preferably, the receiving means is arranged to receive a blister pack so that the selected blister faces the abutment means, the latter being operable to exert said collapsing force by directly engaging the blister.

Preferably, the receiving means comprises a pair of opposed jaws.

One of those jaws may conveniently be so shaped as to locate a selected blister in registry with the abutment means, and to that end may have a recess, of a complimentary shape to that of a blister.

The abutment means may be incorporated into the receiving means, but preferably comprises a plunger movably mounted on a jaw on the receiving means.

Preferably, the biasing means is integrally formed with the jaw, and conveniently comprises a resiliently flexible connecting arm.

Said arm may to advantage be substantially U shaped.

Such an arrangement can simplify the construction, and hence reduce the production costs, of the apparatus.

Preferably, the biasing means biases the jaws into a neutral position, in which they are spaced apart so as to be able to receive a blister pack. This spacing allows the user to move the jaws against the action of the biasing means simply by inserting a blister pack into the space between the jaws.

The apparatus may advantageously include a further biasing means which acts between the plunger and the jaw in which it is mounted so as to urge the plunger away from the other jaw.

The further biasing means is preferably arranged to exert a sufficient biasing force on the plunger to make it difficult for a small child to use the device to obtain a tablet, whilst not significantly detracting from the facility that the device provides for its intended user.

Preferably, the further biasing means comprises a resiliently compressible member.

Such a member conveniently comprises a sleeve which extends around the plunger.

Preferably, the apparatus includes a base for supporting the jaws on a supporting surface, the base including an opening and a chute for conducting a tablet release from a blister pack to the opening. Another advantages associated with the apparatus is that the plunger can have a head, to be pressed by the user, which is considerably larger than a blister, since the need to provide a respective abutment for each blister is avoided by having receiving means which can receive the blister pack in any one of a number of possible positions, in each of which a respective blister is in registry with the plunger.

BRIEF DESCRIPTION OF THE DRAWINGS

The invention will now be described, by way of example only, with reference to the accompanying drawings in which:

FIGS. 3*a*-6*a* are views, similar to FIG. 1*a*, at each of the stages shown in FIGS. 3-6 respectively.

DETAILED DESCRIPTION

Figure 1:
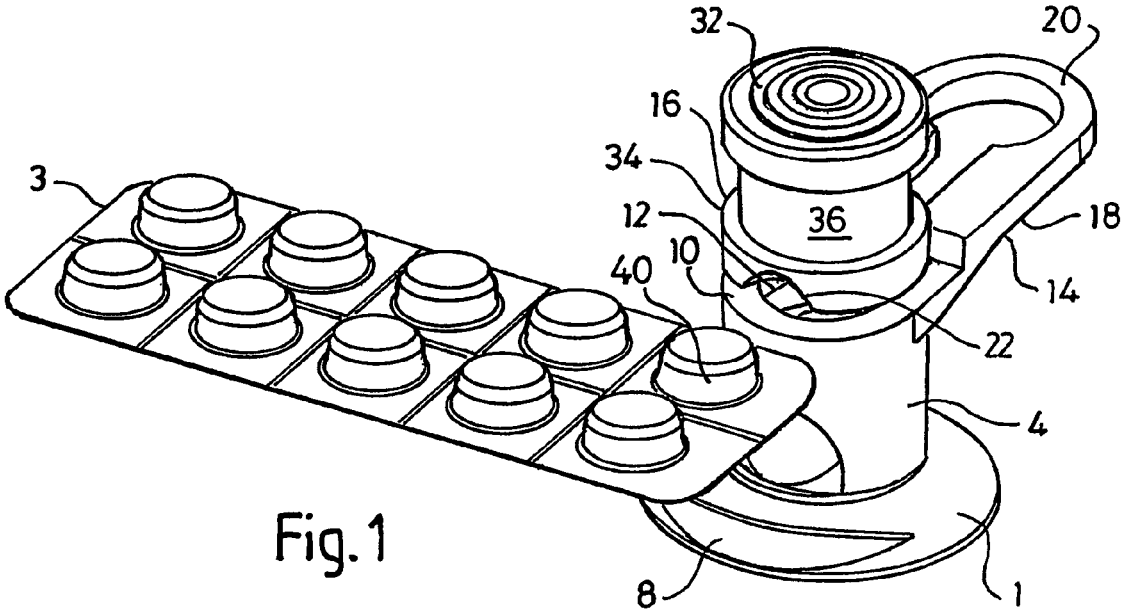
FIG. 1 is an isometric view of apparatus in accordance with the invention and a blister pack for use therewith.
Figure 1A:
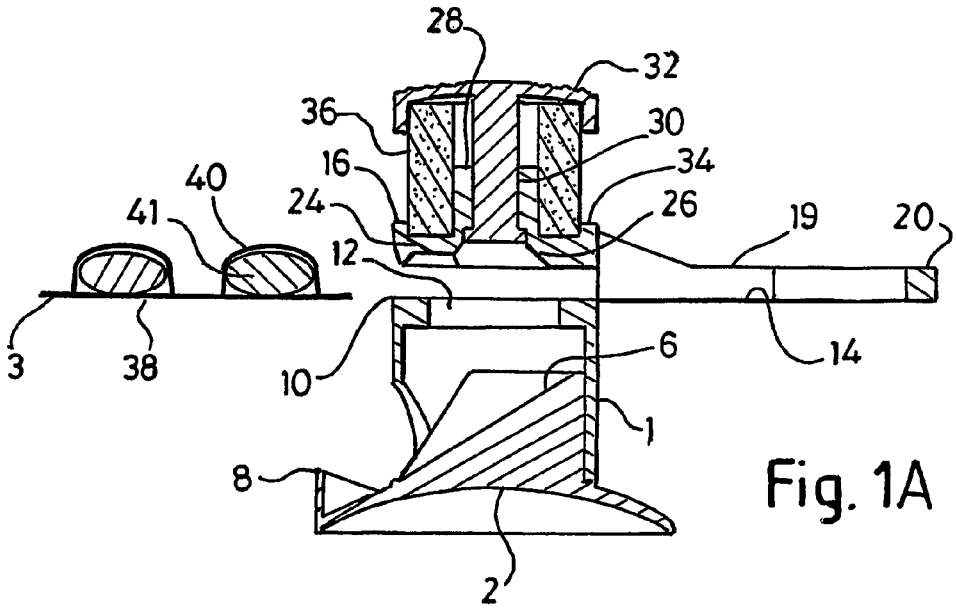
FIG. 1*a* is a sectional side view of the apparatus and blister pack of FIG. 1.
Figure 2:
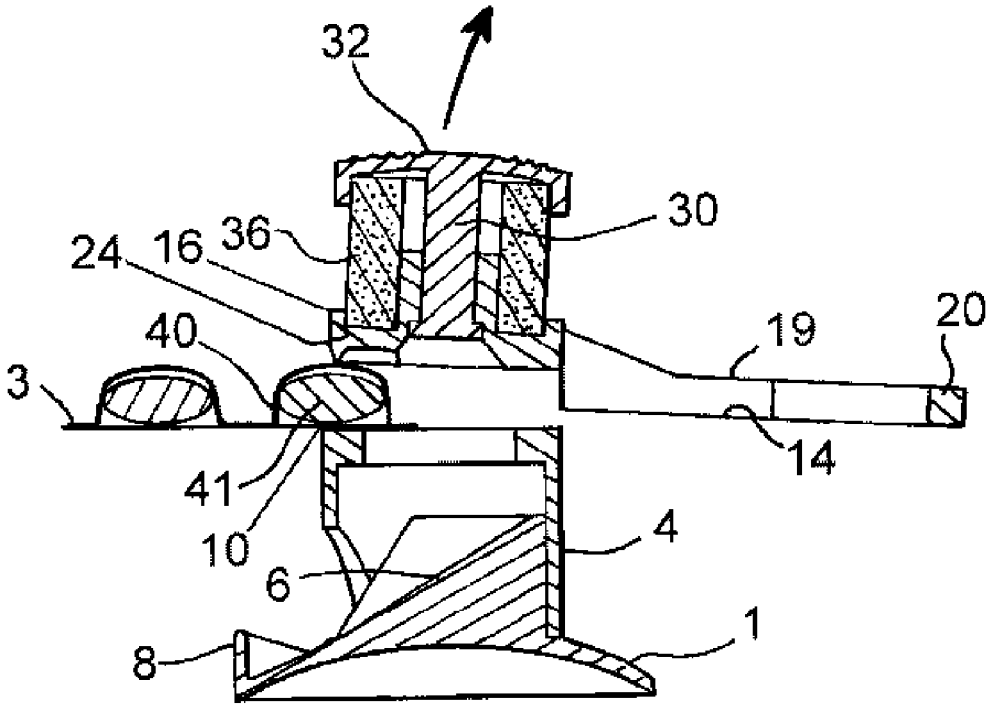
FIG. 2 is a sectional side view of the apparatus showing insertion of the blister pack midway between FIGS. 1*a* and 3*a*, with the upper law rotated upwardly.

The apparatus in accordance with the invention comprises a base one which has a circular edge and a domed underside (referenced to in FIG. 1*a*). A hollow circularly cylindrical column 4 extends upwardly from the centre of base 1 and incorporates an internal sloped chute 6 the bottom of which is situated adjacent an arcuate peripheral wall 8 on the base 1. The top surface 10 of the column 4 constitutes the lower jaw of the receiving means of the apparatus and also defines a central aperture 12 through which a tablet released by the apparatus can fall into the chute 6 and hence to the wall 8.

A generally U-shaped arm has one end formed integrally with the lower jaw 10, and extends naturally away from the lower jaw 10. The other end of the arm 14 carries an upper jaw 16 positioned immediately above the lower jaw 10, but spaced from the latter so as to define an opening between the two jaws. The arm 14 has two identical straight, portions, one of which is shown at 18, connected together by a curved portion 20 of reduced thickness. The second straight portion of the arm 14 is shown at 19 in FIG. 1*a*. The arm 14 is resiliently flexible in particularly the region of portion 20 so as to bias the upper jaw 16 into the position shown in FIG. 1*a*.

The front of the jaw 16 is provided with a curved recess 22 having a front downwardly facing chamber 24 that acts as a camming surface.

The underside of the jaw 16 also includes a central recess 26 which is tapered, and in use locates a blister from the blister pack 3.

A hollow cylindrical stem 28 extends upwardly from the recess 26, and locates a plunger 30 which is mounted so as to be slidable through the stem 28. A generally circular push button 32 extends radially outwards from the top of the plunger 30, and is formed integrally therewith. The base 1, column 4, arm 14 and jaws are all formed as a single integral unit of a suitable plastic material.

The top of the jaw 16 also includes a circular peripheral wall 34 which, with the stem 28, defines an annular channel in the top of the jaw 16. This channel accommodates the bottom end of a resiliently compressible metal, plastics or foam spring. In this particular example, the spring is a cylinder 36 of a resiliently compressible foam material, the top of which acts directly on the underside of the button 32.

The blister pack 3, in this example, comprises 2 parallel rows, each of 5 blisters, in each of which a respective single tablet. These tablets are held in position by a sheet of heat sealed foil 38 on the underside of the pack 3.

When a tablet is to be released from a given blister, for example the blister 40, the pack 3 is positioned with the blister 40 in alignment with the recess 22 in the upper jaw 16. The blister 40 is then moved directly towards the recess 22 until it engages the camming surface 24. The height of the blister is slightly greater than the distance between the two jaws at the recess 12, and the engagement of the blister 40 with the camming surface 24 therefore tends to urge the two jaws apart so as to allow the blister 40 to be inserted into disposed between the jaws. As a blister approaches the recess 34, the biasing provided by the arm 14 causes the blister to be gently squeezed by the jaws and thereby to be urged into the recess 34. Thus the two jaws, operating in conjunction with the arm 14, will locate and retain the blister 40 into position in registry with the plunger 30.

Figure 3:
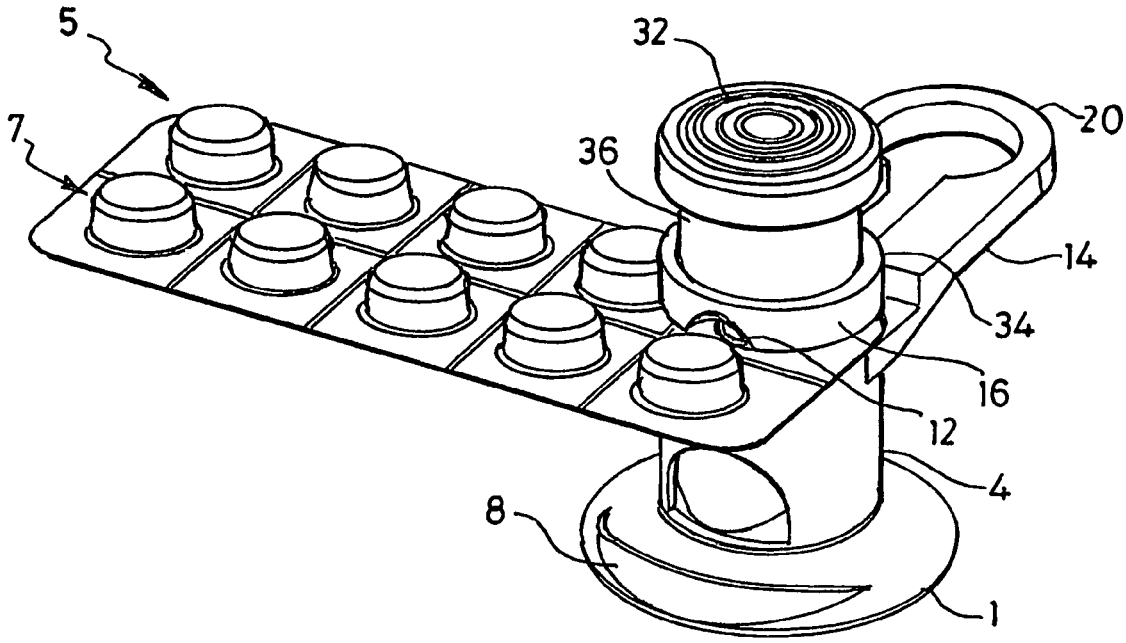
FIGS. 3-6 are views, corresponding to FIG. 1, of the apparatus and blister pack during various stages in the operation of the apparatus.
Figure 3A:
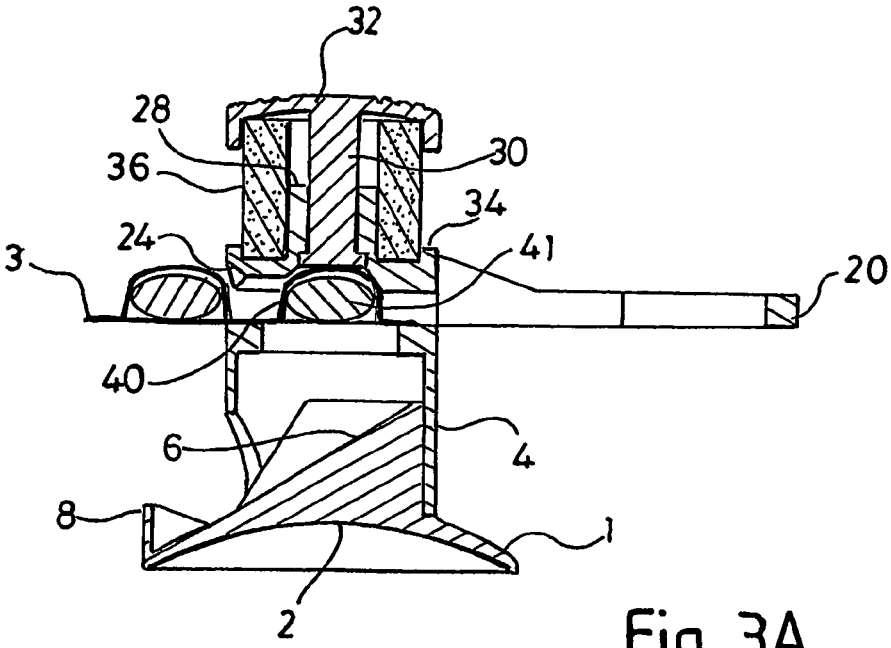

This position is shown in FIGS. 3 and 3*a*.

Figure 4:
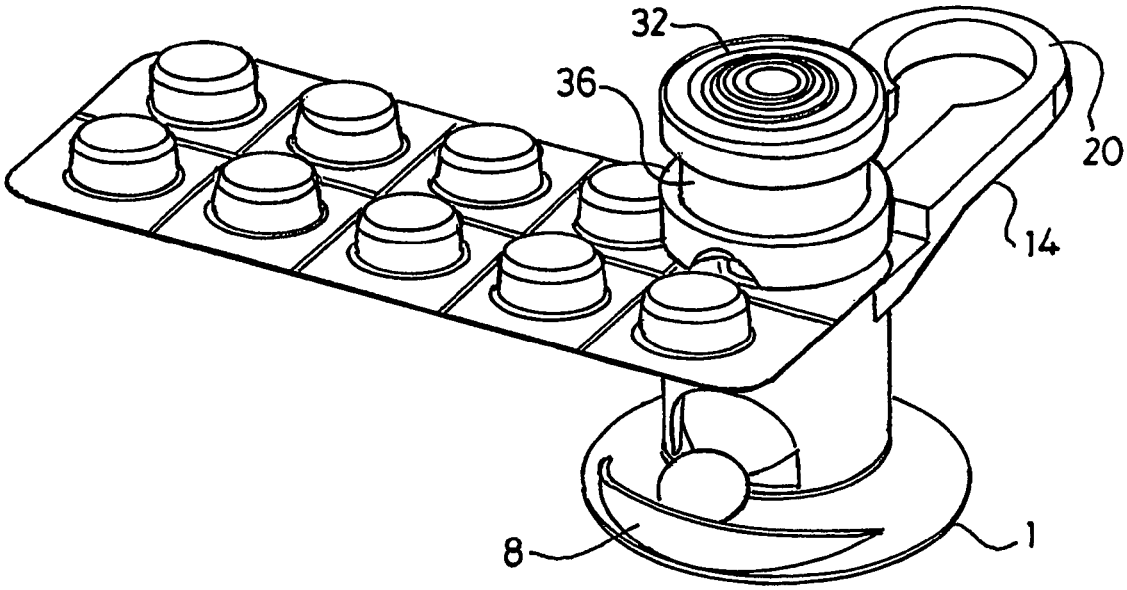
Figure 4A:
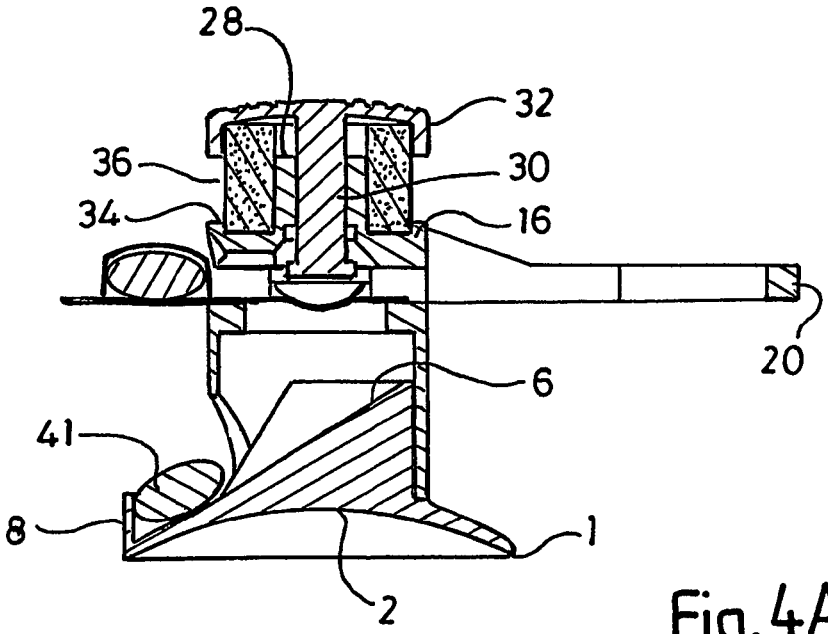

Referring to FIGS. 4 and 4*a*, the user then presses on the button 32 and thus urges the plunger 30 against the top of the blister 40. Since the button 32 has a much larger area than the underside of the plunger 30, a given pressure exerted evenly to the button 32 will cause the plunger 32 to exert a much larger pressure on the blister 40. This helps the user to exert a sufficient force on the blister 40 to rupture the portion of the foil which seals that blister and thus to allow the tablet (reference 41) previously in the blister 40 to fall from the bottom of the pack, through the opening 12 and on to the chute 16, which then conveys the tablet 41 to the front of the base, to the position shown in FIGS. 4 and 4*a*, in which the tablet rests against wall 8.

Figure 5:
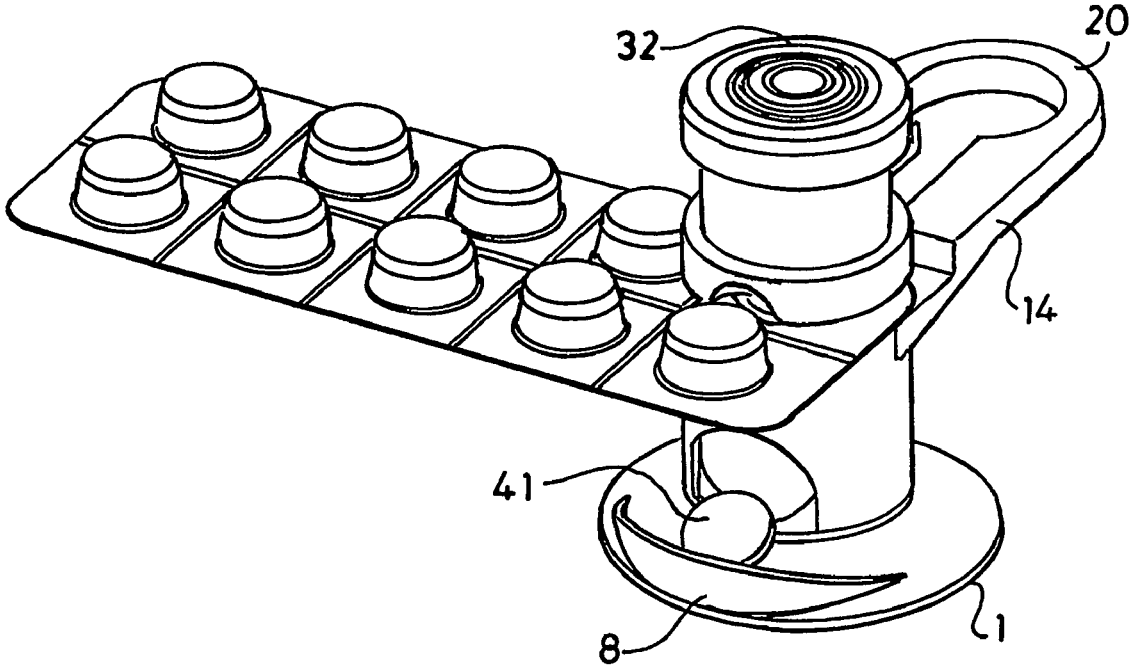
Figure 5A:
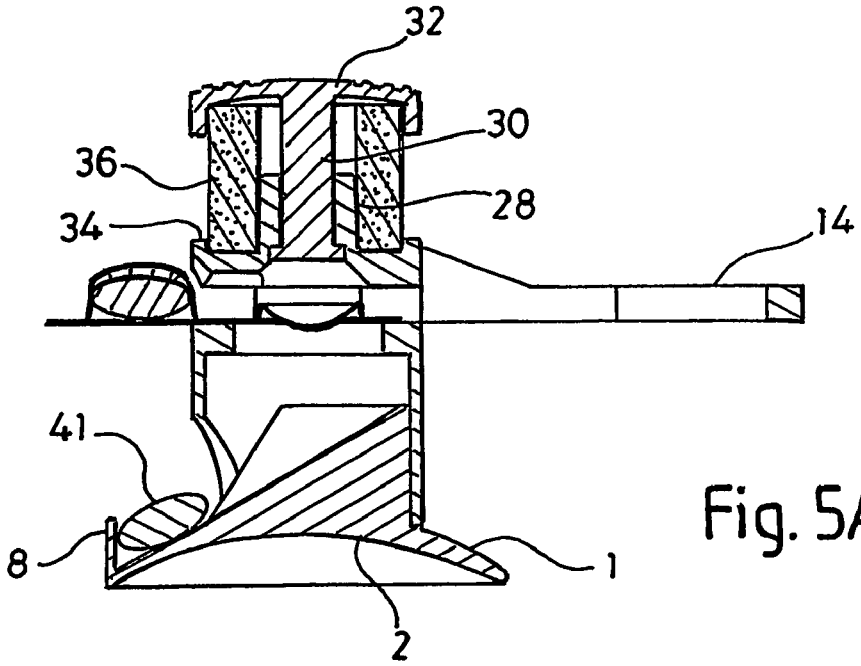
Figure 6:
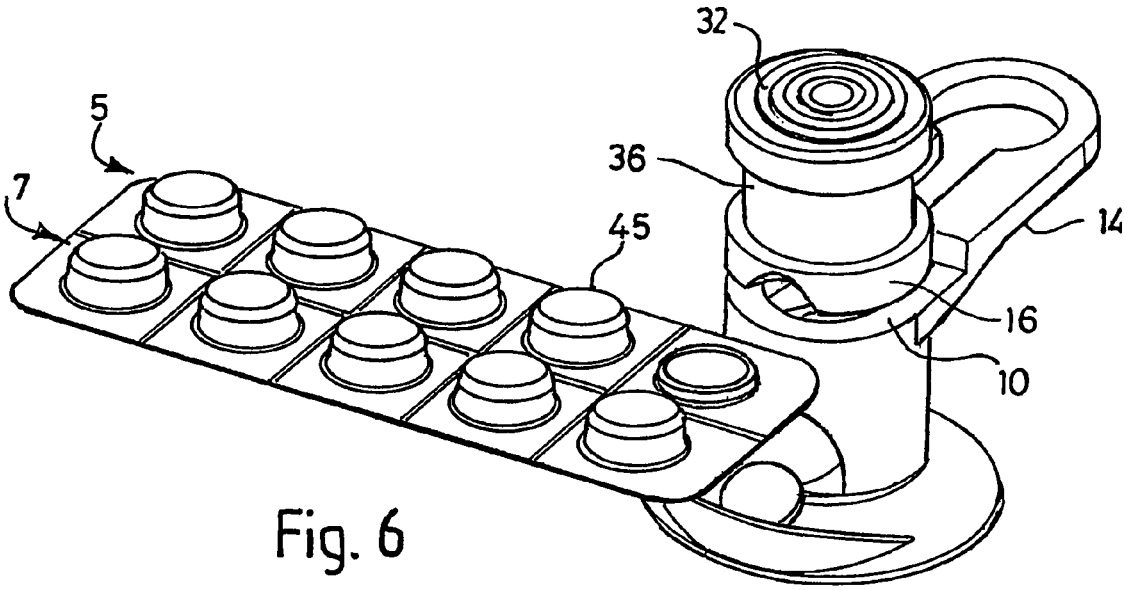
Figure 6A:
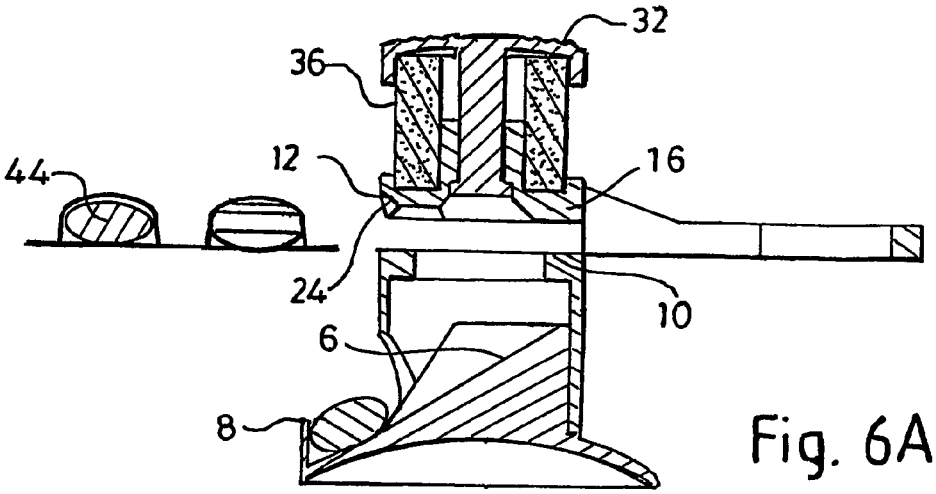

The user the releases button 32 causing the plunger 30 to be urged upwardly by the sleeve 36 into the position shown in FIGS. 5 and 5*a*, and thus to enable the blister pack to be removed as shown in FIGS. 6 and 6*a*. The user can then easily retrieve the tablet 41 from the front of the base 1.

If the next tablet 44 is to be released from the blister 45, the pack 3 is moved until the blister 45 is alignment with the recess 12 and the process is repeated. Once all the blisters have been released from the first of the rows 5 and 7 the pack is re-orientated so that the second of those rows is closer to the apparatus.

It will be appreciated from the forgoing that the apparatus functions in a similar fashion to a ticket stamp.

Figure 7:
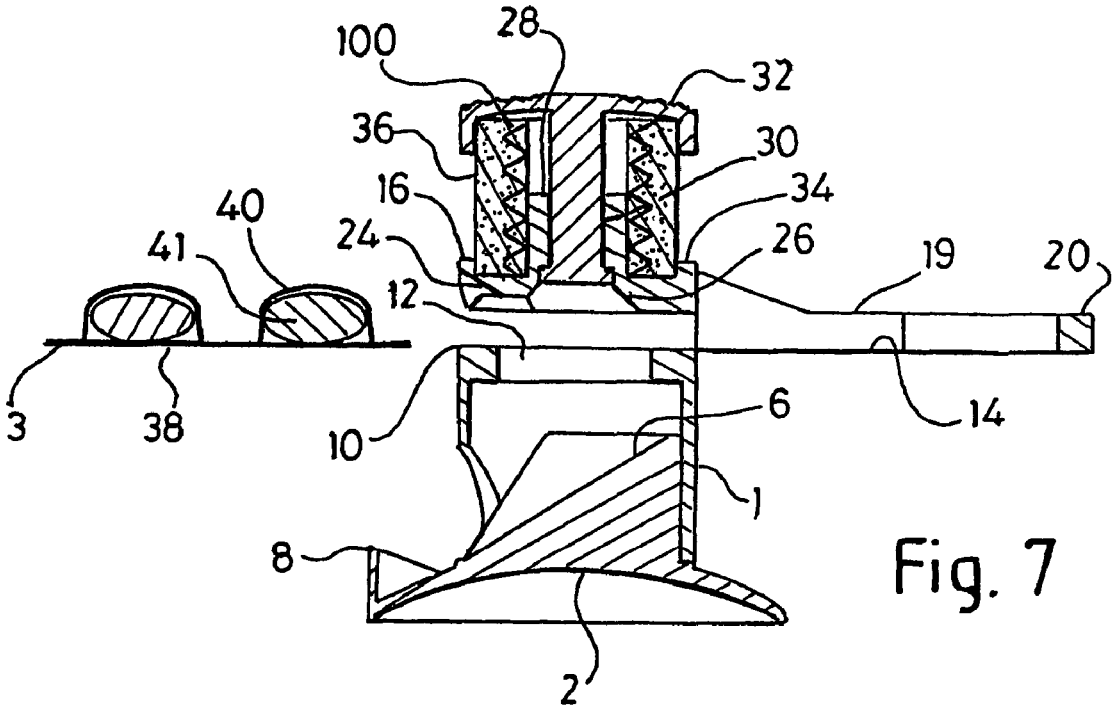
FIG. 7 is a sectional view, corresponding to FIG. 1*a*, of a second embodiment of apparatus in accordance with the invention.

With reference to FIG. 7 the second embodiment is similar in many respects to the first embodiment, and the reference numeral used in FIG. 1*a* are also used to denote the corresponding parts of the second embodiment. In the second embodiment the foam spring 36 is assisted by a helical spring 100 of metal, plastics or similar material.

The spring 100 is seated in the same channel as the foam cylinder 36, and sits between that channel and the underside of the button 32.

In a modified version of the second embodiment, a sleeve of a resiliently compressible material other than foam replaces the sleeve 36.

The invention claimed is:

1. Apparatus for releasing tablets from a blister pack having a plurality of tablets contained in corresponding blisters, the apparatus comprising abutment means, receiving means for receiving a blister pack with any selected one of a plurality of blisters of the pack in registry with the abutment means, the receiving means comprising a pair of opposed jaws, the jaws being moveable relative to one another, either one of the abutment means or the receiving means being moveable to cause a collapsing force to be exerted on a selected blister thereby to release a tablet from the blister, wherein the apparatus includes first biasing means integrally formed with a jaw for urging the receiving means into engagement with the blister pack, and the receiving means is so arranged that said engagement releasably retains, and locates, the blister pack in position relative to the abutment means prior to the release of the tablet, and wherein the first biasing means comprises a resiliently flexible substantially u-shaped connecting arm that is operable to bias the jaws into a neutral position, in which they are spaced apart and opposed so as to be able to receive a blister pack, allowing a user to move the opposed jaws against the action of the first biasing means by inserting a blister pack into the space between the jaws, wherein the abutment means comprises a plunger moveably mounted on a jaw of the receiving means, wherein the apparatus includes a further biasing means which acts between the plunger and the jaw in which it is mounted so as to urge the plunger away from the other jaw, the further biasing means comprising a resiliently compressible sleeve which extends around the plunger, and wherein the apparatus includes a base for supporting the jaws on a supporting surface, the base including an opening and a chute for conveying a tablet released from a blister pack to the opening.

2. Apparatus according to claim 1, wherein the abutment means is moveable towards a blister of a pack retained in the receiving means.

3. Apparatus according to claim 1, wherein the receiving means is arranged to receive a blister pack so that the selected blister faces the abutment means, the latter being operable to exert said collapsing force by directly engaging the blister.

4. Apparatus according to claim 1, wherein one of the jaws is so shaped as to locate a selected blister in registry with the abutment means, and has a recess of a complimentary shape to that of a blister.

5. Apparatus according to claim 1, wherein the further biasing means is arranged to exert a sufficient biasing force on the plunger so as to make it difficult for a small child to use the device to obtain a tablet.

6. Apparatus according to claim 1, wherein the plunger has a head, to be pressed by the user, which is considerably larger than a blister.

7. Apparatus according to claim 1, wherein one of the jaws of the receiving means includes a camming surface for engagement by a blister on lateral movement, to move the jaws apart against the first biasing means.

8. Apparatus according to claim 1 in which said u-shaped connecting arm is resiliently flexible in the region of the curved portion thereof.

* * * * *